US007390950B2

(12) United States Patent
Hollander

(10) Patent No.: US 7,390,950 B2
(45) Date of Patent: Jun. 24, 2008

(54) ACOUSTIC MICROPHONE SUPPORT BRACKET

(76) Inventor: Ryan S. Hollander, 5020 Brookmere Rd., Winston-Salem, NC (US) 27106

( * ) Notice: Subject to any disclaimer, the term of this patent is extended or adjusted under 35 U.S.C. 154(b) by 180 days.

(21) Appl. No.: 11/317,599

(22) Filed: Dec. 23, 2005

(65) Prior Publication Data

US 2007/0144329 A1 Jun. 28, 2007

(51) Int. Cl.
*G10D 9/00* (2006.01)
*G10D 3/00* (2006.01)

(52) U.S. Cl. ..... 84/453; 84/453; 84/290

(58) Field of Classification Search ..... 84/290, 84/453

See application file for complete search history.

(56) References Cited

U.S. PATENT DOCUMENTS

| | | | | | |
|---|---|---|---|---|---|
| 397,541 | A | * | 2/1889 | Gaertner | 84/379 |
| 1,762,645 | A | * | 6/1930 | Spalleno | 84/170 |
| 1,912,654 | A | * | 6/1933 | Peterson | 84/379 |
| 3,020,017 | A | * | 2/1962 | Watson | 248/205.8 |
| 3,101,566 | A | * | 8/1963 | Stiller | 248/346.11 |
| 3,496,297 | A | * | 2/1970 | Brumberger | 381/118 |
| 3,665,490 | A | * | 5/1972 | Oskar | 381/366 |
| 3,676,940 | A | * | 7/1972 | Shively | 36/8.1 |
| 3,781,451 | A | * | 12/1973 | Nolan | 84/723 |
| 4,168,647 | A | * | 9/1979 | Petillo | 84/731 |
| 4,235,041 | A | * | 11/1980 | Sweet | 446/177 |
| 4,495,641 | A | * | 1/1985 | Vernino | 381/91 |
| D279,905 | S | * | 7/1985 | Whited | D17/13 |
| 4,580,751 | A | * | 4/1986 | Panzer | 248/205.8 |
| 4,966,062 | A | * | 10/1990 | Driggers et al. | 84/327 |
| 5,422,955 | A | * | 6/1995 | Guzman et al. | 381/77 |
| 5,567,903 | A | * | 10/1996 | Coopersmith et al. | 84/723 |
| 5,568,549 | A | * | 10/1996 | Wang | 379/446 |
| 5,779,205 | A | * | 7/1998 | Ching | 248/205.8 |
| 5,847,298 | A | * | 12/1998 | Adams | 84/314 R |
| 5,961,087 | A | * | 10/1999 | Lee | 248/362 |
| 6,005,175 | A | * | 12/1999 | Johnson | 84/327 |
| 6,040,509 | A | * | 3/2000 | Fanella | 84/280 |
| 6,061,457 | A | * | 5/2000 | Stockhamer | 381/111 |
| 6,252,150 | B1 | * | 6/2001 | Johnson | 84/327 |
| 6,257,535 | B1 | * | 7/2001 | Jaing | 248/205.5 |
| 6,422,522 | B1 | * | 7/2002 | Woollen | 248/166 |
| 6,441,292 | B1 | * | 8/2002 | Donnell | 84/723 |
| 6,498,859 | B2 | * | 12/2002 | Kuerti et al. | 381/361 |
| 6,637,707 | B1 | * | 10/2003 | Gates et al. | 248/224.7 |

(Continued)

*Primary Examiner*—Lincoln Donovan
*Assistant Examiner*—Robert W Horn
(74) *Attorney, Agent, or Firm*—Anthony H Hanpal; Shivani Kaul; Shelly Dorn

(57) ABSTRACT

A stringed instrument microphone which is particularly optimized for many players of stringed instruments is disclosed. Uniformity and faithfulness of the electrical output is provided by employing a high-quality microphone mounted by a fraction to the sound box at a fixed position in which it does not interfere with the playing of the instrument. At the same time gone variation of this position is accommodated with a structure which maintains position rigorously. This is important because infinitesimally small variations in position will produce clearly audible distortions. In accordance with the invention it has been discovered that such variations may be caused, among other factors, by vibration of the sound box, a flexible or otherwise displaceable bracket structure and resonance in the bracket. The present invention optimizes the solution by providing a mounting configuration, multiple bracket material selections and arrangements, microphone characteristics and bracket configuration which cooperate to minimize distortions.

14 Claims, 9 Drawing Sheets

U.S. PATENT DOCUMENTS 6,680,431 B2 * 1/2004 Vanden et al. ..... 84/279
6,757,400 B1 * 6/2004 Cheng ..... 381/361
6,842,528 B2 * 1/2005 Kuerti et al. ..... 381/361
6,962,314 B2 * 11/2005 Hsu ..... 248/205.5
D521,990 S * 5/2006 Richter ..... D14/253
7,176,366 B1 * 2/2007 Bruce ..... 84/327
7,205,468 B1 * 4/2007 Johnson ..... 84/327
7,214,871 B2 * 5/2007 Hasenmaier ..... 84/723
7,229,059 B1 * 6/2007 Hood ..... 248/518
7,233,661 B2 * 6/2007 Palett et al. ..... 379/455
7,247,789 B2 * 7/2007 Fishman et al. ..... 84/723
2002/0158033 A1 * 10/2002 Chen ..... 211/103
2003/0121395 A1 * 7/2003 Smith ..... 84/327
2005/0087062 A1 * 4/2005 Kiyohiko ..... 84/723
2005/0262987 A1 * 12/2005 Chen ..... 84/453
2006/0081116 A1 * 4/2006 Copeland et al. ..... 84/421
2007/0144329 A1 * 6/2007 Hollander ..... 84/290

* cited by examiner

FIGURE 20
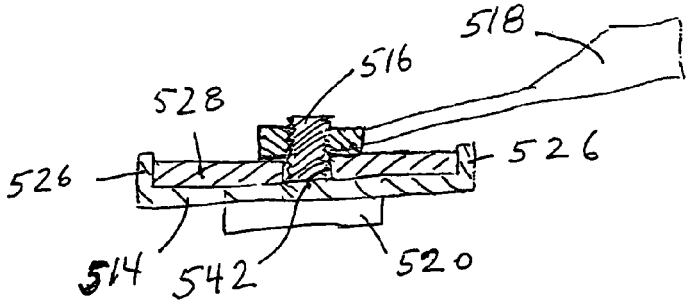
FIGURE 21
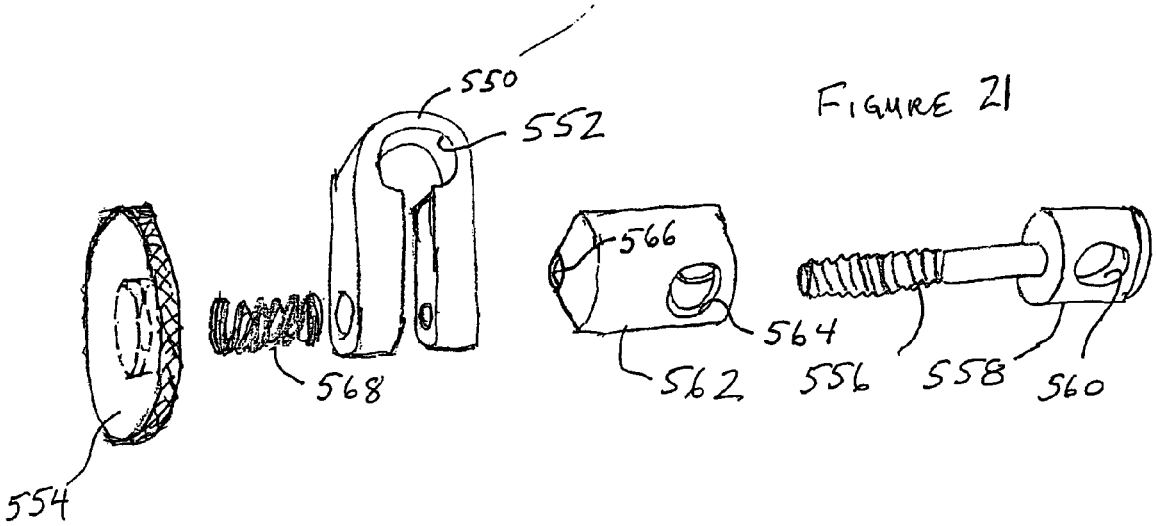
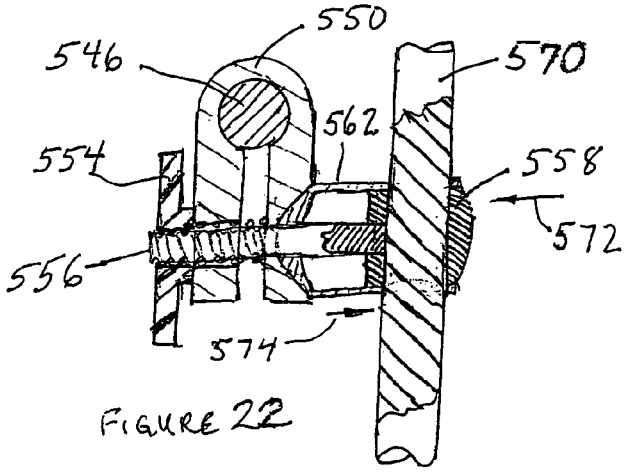
FIGURE 22

ACOUSTIC MICROPHONE SUPPORT BRACKET

TECHNICAL FIELD the present invention relates to brackets for supporting microphones to receive sound from an acoustic guitar, for example, or other acoustic string instrument, such as a classical violin, and generate an electrical signal for amplification consistent with the aesthetics instrument artistry.

BACKGROUND

Stringed instruments have been known since ancient times. These included such instruments as the lute, a guitarlike instrument with a sound box and fretboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade variety, in a wide range of musical genres including blues, bluegrass, and so forth. Not surprisingly, with the advent of the electronic age in the early twentieth century, artists began searching for ways to amplify music produced by standard instruments. Perhaps the first "instrument" to be amplified was the human voice. Not far behind, however, was the guitar, which could be played in close proximity to the microphone, particularly during interludes in the music where the performer was not singing.

As musicians searched for ways to amplify the output of the stringed musical instrument, a variety of approaches came to be adopted in an attempt to obtain an electrical output from stringed instruments, such as the guitar. These included the use of transducers which may be mounted on a microphone stand or mounted on the sound box. Alternatively, the "microphone" may take the form of a transducer mounted on the body of the instrument, operating using a range of detection techniques, such as electromagnetic, piezoelectric or mechanical detection. Such alternative techniques have generally been the most widely accepted, due to a series of problems with using microphones.

However, over the years, artists playing acoustic stringed instruments have introduced a wide variety of techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked.

However, microphone alternatives, despite their popularity, are not well suited for obtaining electrical signals corresponding to such a wide range of acoustic artists' performance techniques. Moreover, the amplified sound produced by such "microphone" alternatives is not comparable to that of an acoustic performance.

Accordingly, there is a need for a stringed instrument microphone which is easy to use during a performance, consistent, and rigorous in its transduction of an acoustic performance into an electrical signal for amplification. It is believed that the structure disclosed herein is the most effective solution with the style of many acoustic stringed instrument performers.

SUMMARY OF THE INVENTION

In accordance with the invention, a stringed instrument microphone which is particularly optimized for many players of stringed instruments is provided. Uniformity and faithfulness of the electrical output is provided by employing a high-quality microphone mounted by a bracket to the sound box at a fixed position in which it does not interfere with the playing of the instrument. At the same time, variation of this position is accommodated with a structure which, once adjusted, maintains position rigorously. This is important because infinitesimally small variations in position will produce clearly audible distortions, vibrational noise and the like. In accordance with the invention, it has been discovered that such variations may be caused, among other factors, by vibration of the sound box, a flexible or otherwise displaceable bracket structure and resonance in the bracket. The present invention optimizes the solution by providing a mounting configuration, multiple bracket material selections and arrangements, microphone characteristics and bracket configuration which cooperate to minimize distortions.

More particularly, in accordance with the invention, the inventive microphone system utilizes a bracket comprising a base member having first and second ends. An upper mounting member is secured to one end of the base member; a lower mounting member secured to the other end of the base member. A microphone holder is secured to one of the mounting members.

The upper and lower mounting members may comprise a pair of adjustable jaw members which may be adjusted to engage the obverse and reverse of a stringed instrument. The adjusted jaws may be locked into position using a threaded member with a knurled knob.

The jaw members may be fitted with shock absorbing protective pads. The shock absorbing protective pads may be made of a material selected from the group consisting of rubber-like materials or felt-like materials.

It is also contemplated that the base member is of adjustable length. Optionally, the bracket may include shock absorber members which bear against the upper and lower sides of the instrument.

In accordance with one embodiment, the microphone holder may be supported by a pair of vibration absorbing members.

THE DESCRIPTION OF THE DRAWINGS

The construction, objects and advantages of the invention will become apparent from the following discussion taken in conjunction with the drawings in which.

Figure 13:
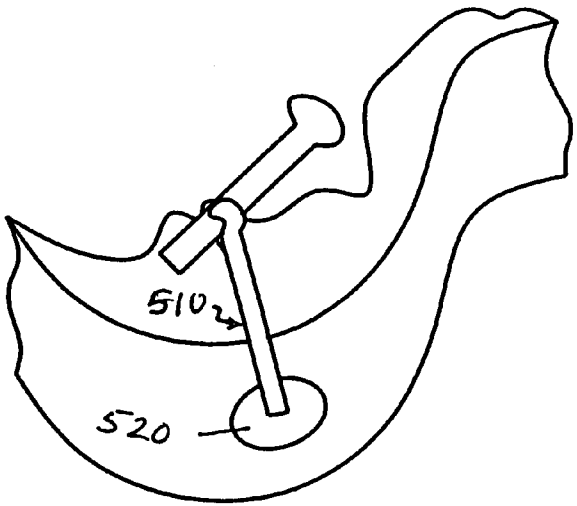
Figure 12:
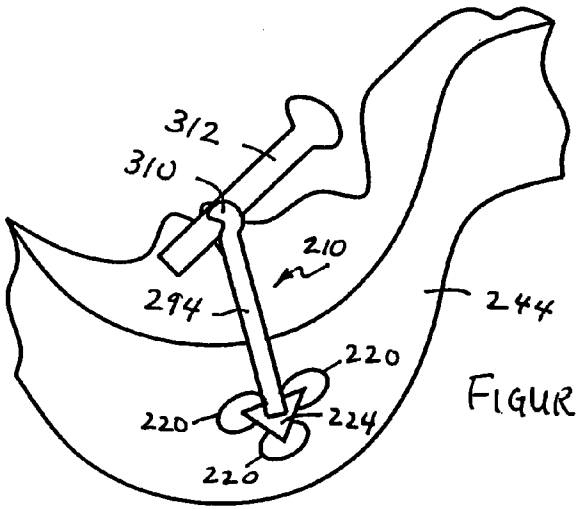
Figure 14:
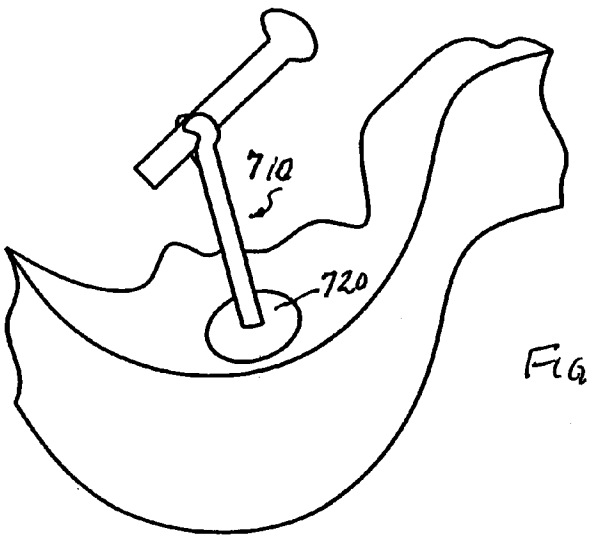
Figures 15, 16, 17, 18:
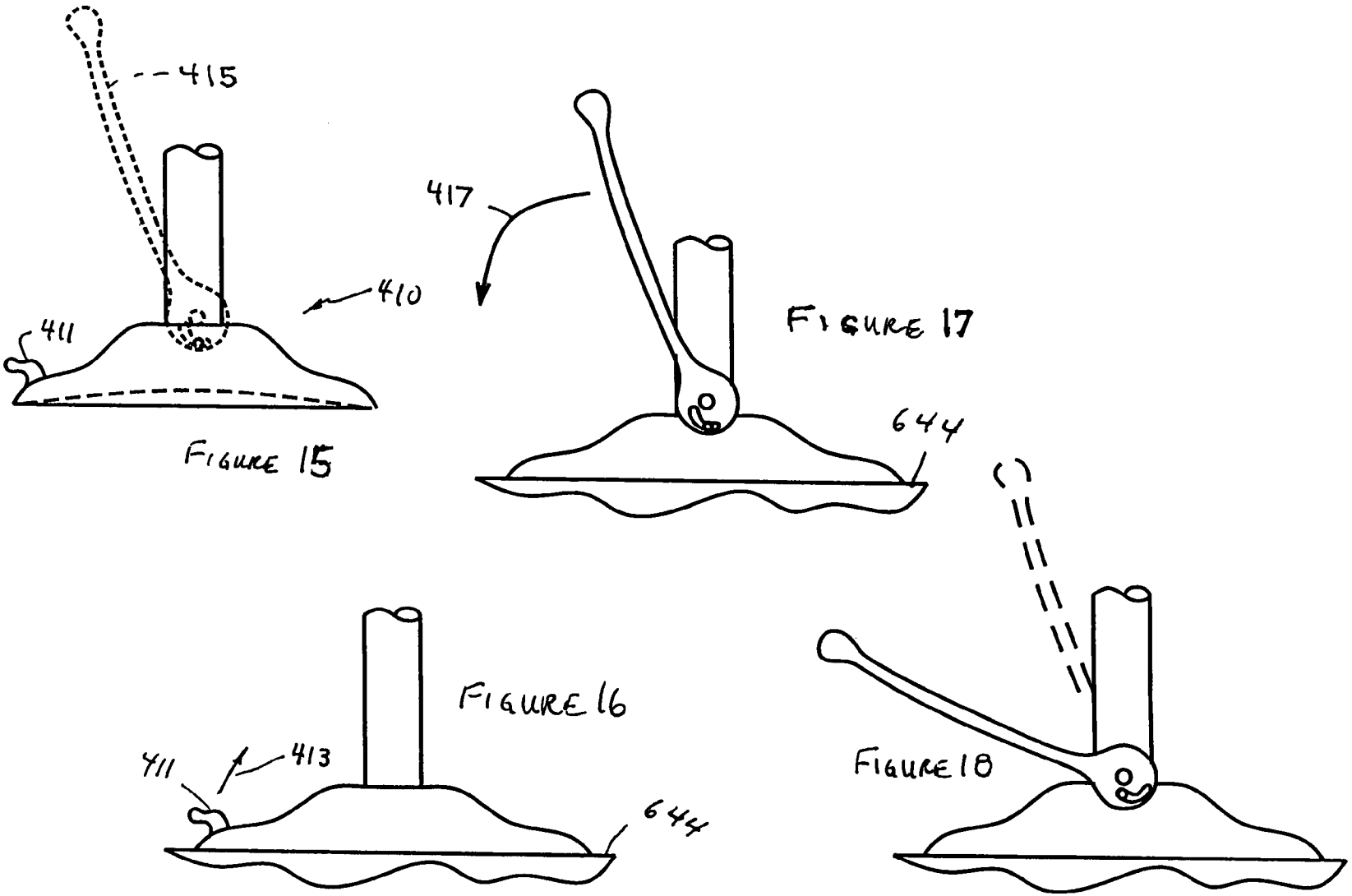
Figure 19:
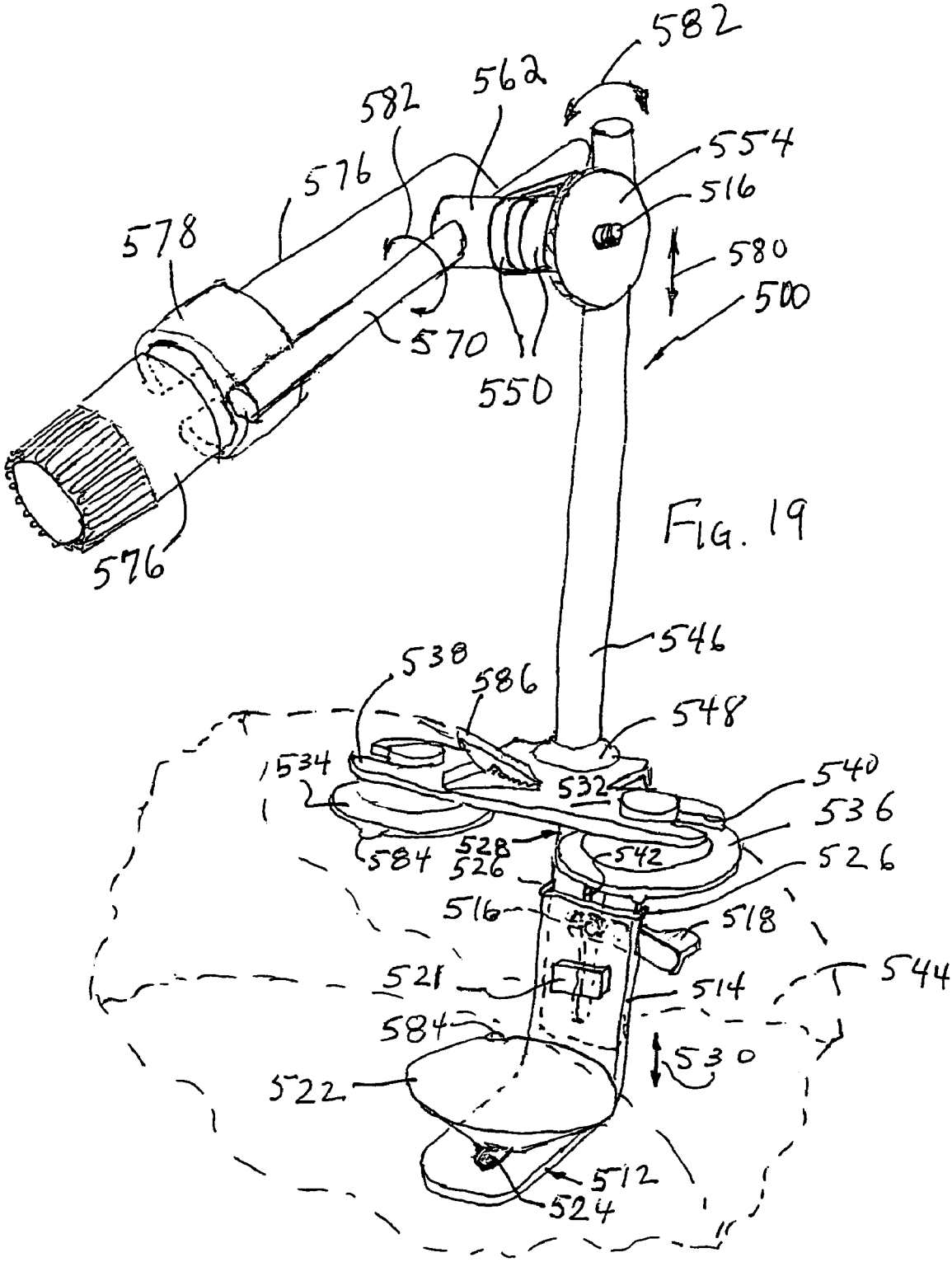

FIG. 12 schematically illustrates an alternative embodiment of the present invention;

FIG. 13 schematically illustrates yet another embodiment of the present invention;

FIG. 14 schematically illustrates yet another alternative embodiment of the invention similar to that of FIG. 13;

FIG. 15 is a detail illustrating a suction cup used in the embodiment, for example, of FIG. 14;

FIG. 16 illustrates the suction cup of FIG. 15 after application;

FIG. 17 illustrates an alternative suction cup useful in the embodiments of FIGS. 12-14; and FIG. 18 illustrates the suction cup of FIG. 17 after the actuation of the engagement mechanism;

FIG. 19 illustrates yet another alternative suction cup based inventive bracket;

FIG. 20 is cross-section of a guitar gripping slider position locking mechanism in use in the bracket of FIG. 19;

FIG. 21 is an exploded perspective of a portion of the microphone position locking mechanism used in the bracket of FIG. 19; and FIG. 22 is a partial cross-section of the microphone position locking mechanism in use in the bracket of FIG. 19.

DETAILED DESCRIPTION OF THE PREFERRED EMBODIMENTS

Figure 1:
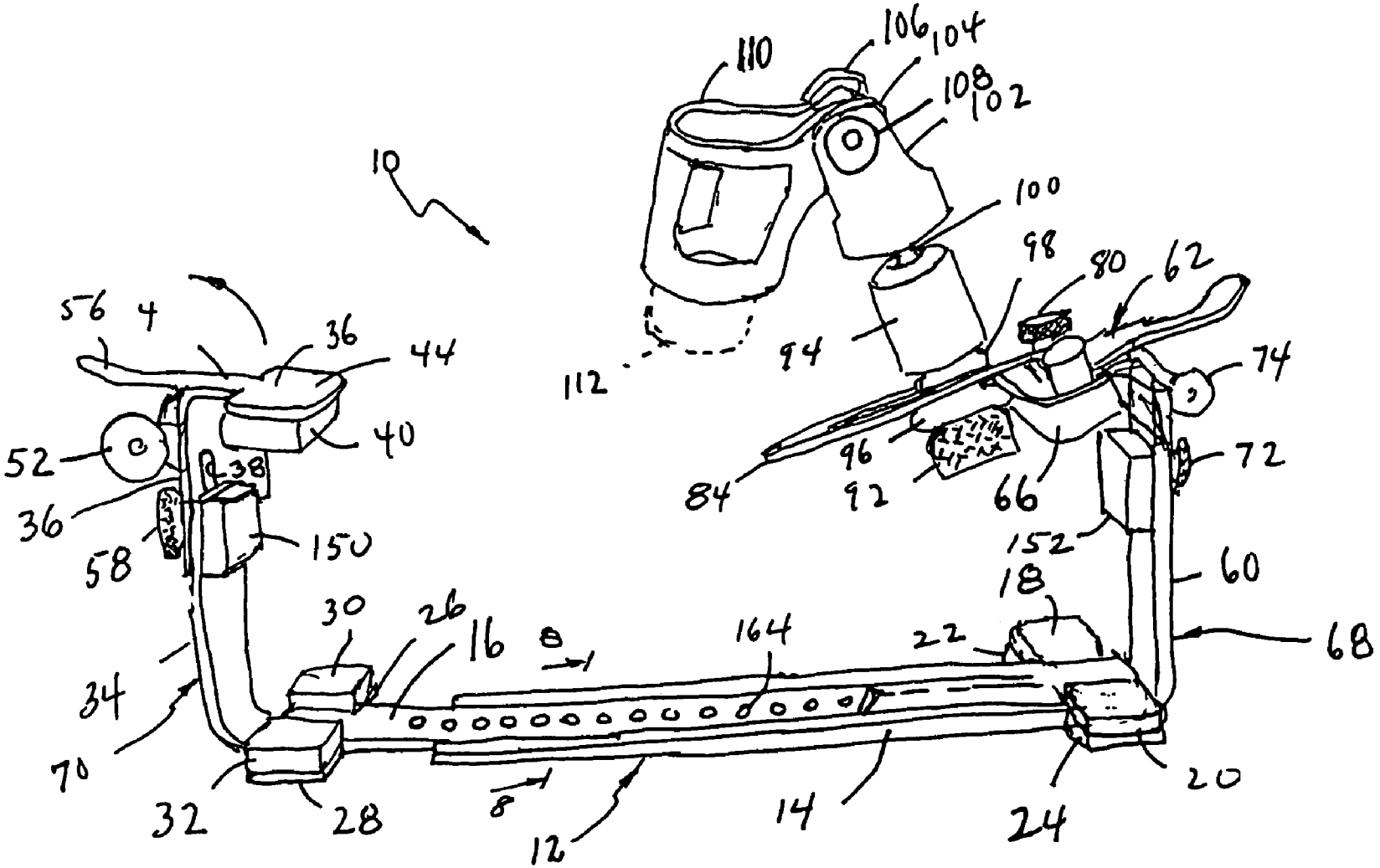
FIG. 1 is a perspective view from the front of the inventive bracket.
Figure 2:
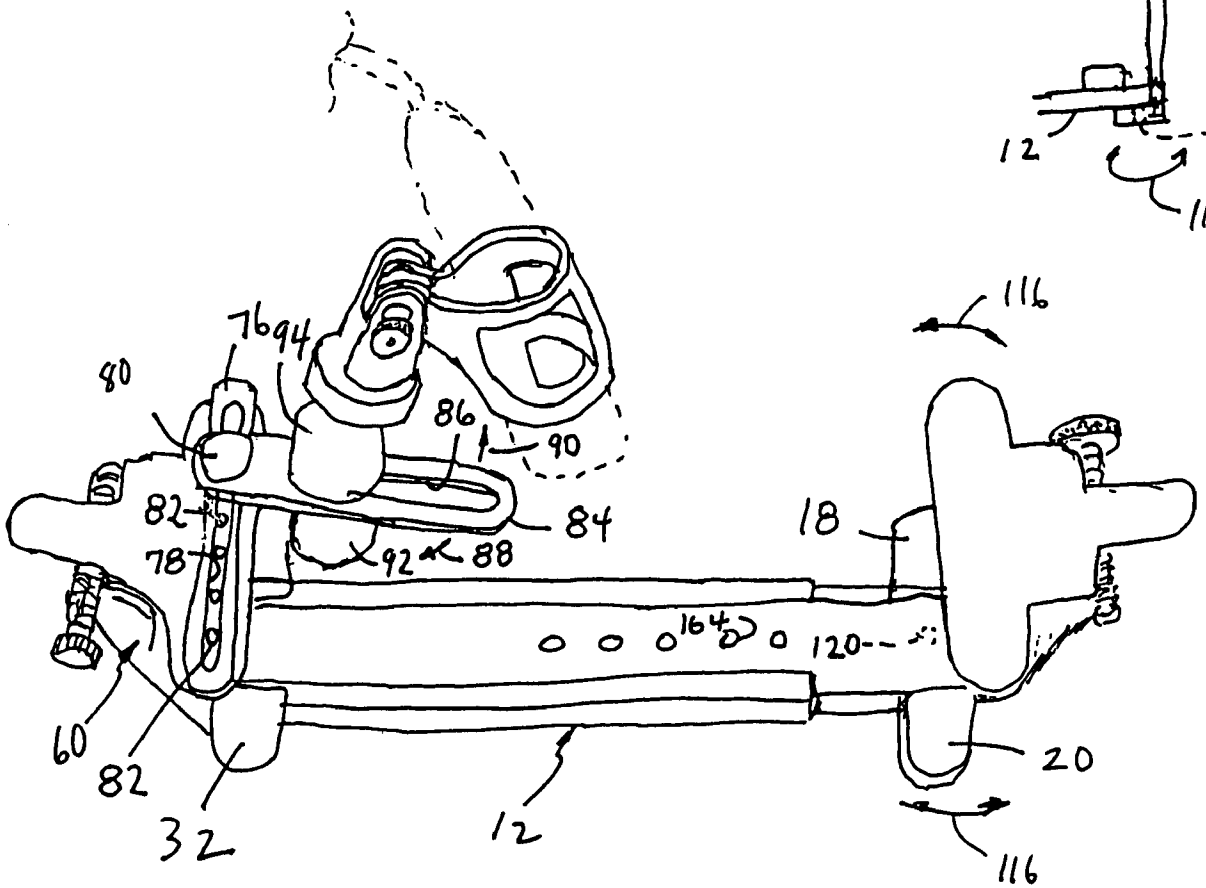
FIG. 2 is a perspective view from the top of the inventive bracket illustrated in FIG. 1.

Referring to FIGS. 1 and 2, a bracket 10 constructed in accordance with the present invention is illustrated. Bracket 10 comprises an adjustable backer member 12. Adjustable backer member 12 is formed by a track member 14 which defines a channel within which a rail 16 slides to adjust to the size of a guitar or other stringed instrument, such as a violin, viola or the like. Once adjusted, it may be locked in place by any suitable mechanism. In this specification, reference to a guitar is made by way of illustration and his meant to encompass other acoustical musical instruments.

Track member 14 supports a pair of hands 18 and 20 which are supported by extensions 22 and 24 which extend from and are integral with track member 14. In similar fashion, rail 16 includes a pair of extensions 26 and 28, which support pads 30 and 32, respectively. Pads 18, 20, 30 and 32 may be made of rubber, felt or any similar material. The material of which the pads are made is selected for its effectiveness in absorbing vibrations and protecting the surface of the guitar from mechanical damage such as scratching or being impressed with grooves or indentations on account of being engaged by the extensions and pads. These considerations also govern the thickness of the pad material, which must be put under relatively high pressure in order to assure mechanical integrity of the joint provided by the bracket.

In connection with this last point, it is noted that vibration of the bracket in all respects may desirably be minimized, and this may be achieved by making the bracket of a relatively sound deadening material and relatively high density. By sound deadening material is meant a material which when deformed has a relatively high mass and resistance to being deformed, and thus is not likely to vibrate or resonate. Resonance can be minimized by designing the bracket with a resonant frequency far below the range of frequencies of sounds produced by the particular instrument with which the bracket is used.

Referring in particular to FIG. 1, rail 16 is formed integral with vertical support member 34. An upper engagement foot 36 defines a channel 38. Upper engagement foot 36 comprises an L-shaped bracket and supports a pad 40 similar to pads 30 and 32. Bracket 36 comprises two parts, namely base 42 (FIG. 3) which includes channel 38, and foot 44, which supports pad 40. Foot 44 is hingedly mounted on base 42 on a pin 48, which passes through vertically extending ears 50 on base 42 and foot 44. When base 42 is in a desired position with respect to foot 44, base 42 may be rigidly secured to foot 44 by tightening of a knurled knob 52 which is mounted on pin 48. Adjustment of foot 44 is accommodated by a lever 56 which is integral with foot 44.

A knurled knob 58 which passes through channel 38 is integral with a threaded shaft (not illustrated), which shaft is received in a tapped hole in vertical support member 34. When bracket 36 has been put in a desired position in which it engages the obverse side of the guitar, for example, it may be secured in position by rotation of knob 58.

Referring in particular to FIG. 2, the bottom of the guitar is engaged by a lower integral vertical support member 60, which, together with hingedly mounted engagement foot 62 engages the lower portion of the guitar with structure similar to that of the bracket defined by vertical support member 34 and engagement foot 36.

Referring to FIG. 1, member 60 and foot 62 thus form a lower bracket which engages the obverse of the instrument by means of a pad 66. The operation of this lower bracket 68 is similar to the operation of the upper bracket 70 defined by vertical support member 34 and bracket 36. Engagement of the obverse and reverse of the instrument is done by adjustment of bracket 68 which is locked in position by knurled knob 72 (which corresponds to knurled knob 58) and knurled knob 74 (which corresponds to knurled knob 52).

Referring to FIG. 2, the track defining metal strip 76 is secured to the top of foot 62. Strip 76 defines eight tracks 78, through which the threaded shaft of a knurled knob 80 passes, being disposed in and meeting with one of a number of selectable tapped holes 82, selected for sound quality, convenience, comfort or the like by the user. Knurled knob 80 adjustably secures a support strip 84 which defines a track 86, in any of holes 82 and at any angle within a range of rotational movement defined by arrows 88 and 90.

Support strip 84 supports a knurled knob 92 which threadedly engages a support base 94, allowing the support base 94 to be secured at any point within track 86. The effects of vibration are minimized by a pad 96 interposed between strip 84 and knob 92, and a second pad 98 interposed between strip 84 and base 94. Knurled knob 92 screws into and is tightened against base 94.

Base 94 is connected by any universal joint member 100 to a clevis 102 which has a pair of clevis arms 104 and 106, which may be drawn together by a threaded member with a knurled knob 108. Accordingly, adjustment of knurled knob 108 results in tightening the rubbery plastic strap 110 to securely hold a microphone 112 which is placed within strap 110.

The instant design is particularly advantageous in so far as a microphone of relatively heavy weight is selected, and that microphone is mounted between a pair of vibration absorbing members 96 and 98, thus isolating the microphone from vibration of the instrument, as well as cushioning the movement of the microphone when the instrument is moved.

Figure 3:
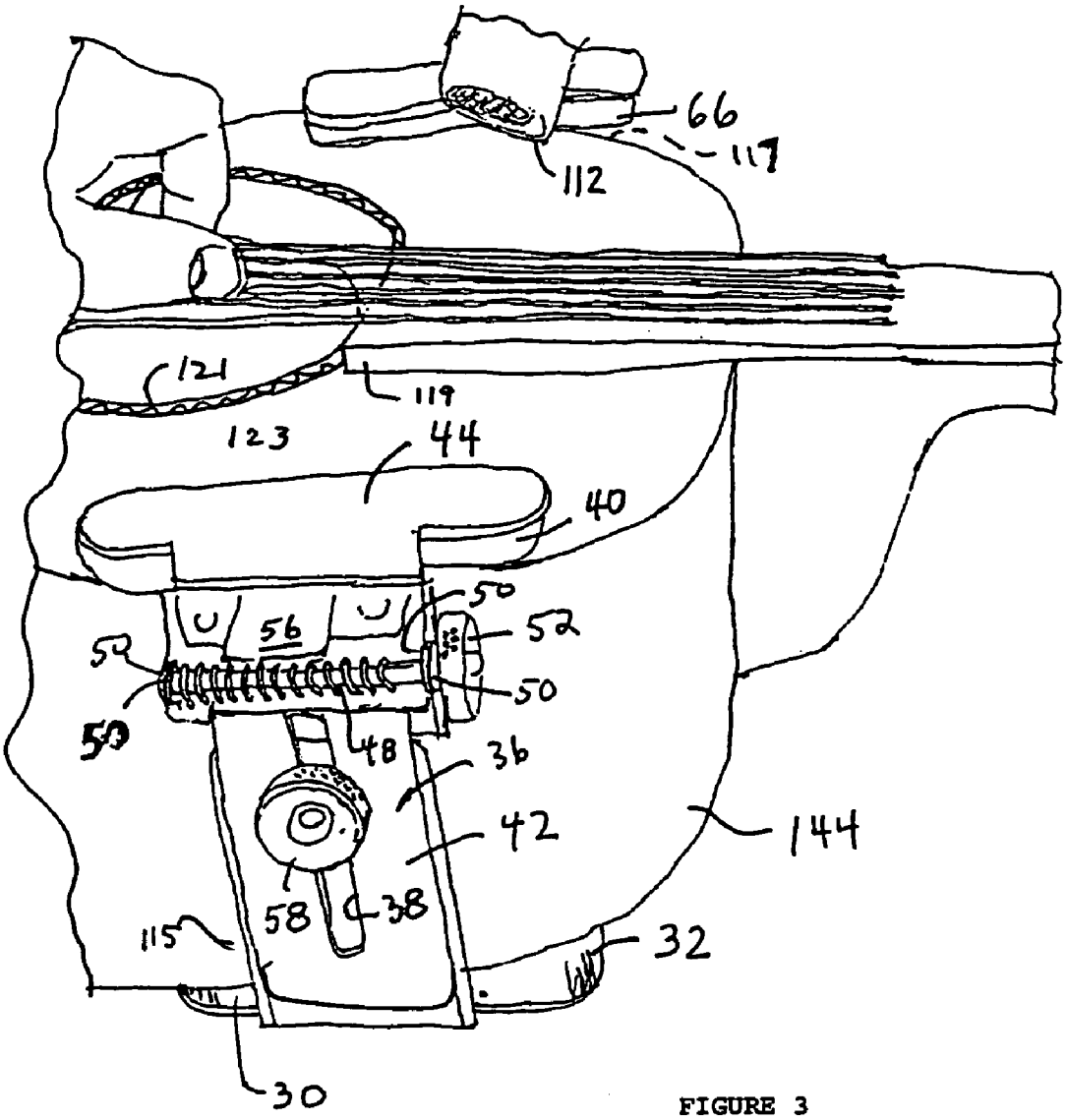
FIG. 3 is a perspective view illustrating the inventive bracket attached to a guitar.

The inventive bracket 10 mounted on an instrument 114, in this case a guitar, is illustrated in FIG. 3.

In accordance with the invention, it is contemplated that the upper and lower sides 115 and 117 of the instrument may not be parallel, and the brackets 68 and 70 may conform to the shape of a typical guitar. Alternatively, the supporting member may be mounted on a pin 120 for rotational movement in the direction of arrows 116, as illustrated in FIG. 2.

In accordance with the invention, it is contemplated that microphone 112 will be aimed to receive sound from the region adjacent the juncture between fretboard 119 and hole 121 in the obverse 123 of the instrument.

Figures 4, 5, 6:
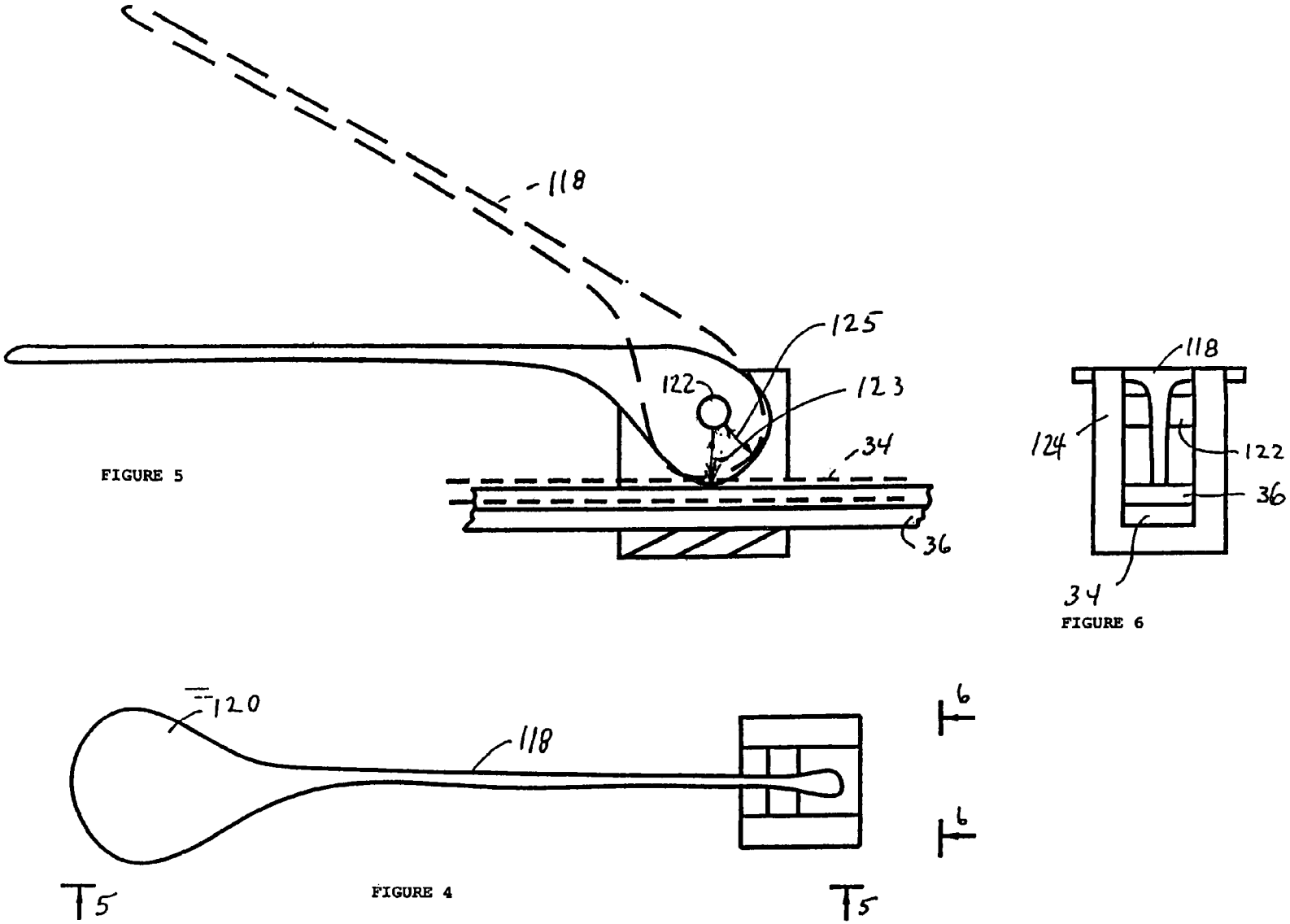
FIG. 4 is a top plain view of a mechanism for tightening components of the inventive bracket.
FIG. 5 is a view along lines 5-5 of the tightening mechanism of FIG. 4.
FIG. 6 is a view along lines 6-6 of the tightening mechanism of FIG. 4.
Figure 8:
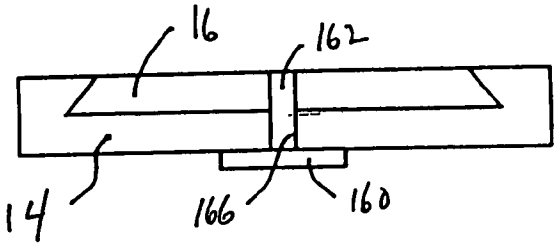
FIGS. 8-11 illustrate a method for securing the inventive bracket on a guitar of a desired size.
Figure 11:
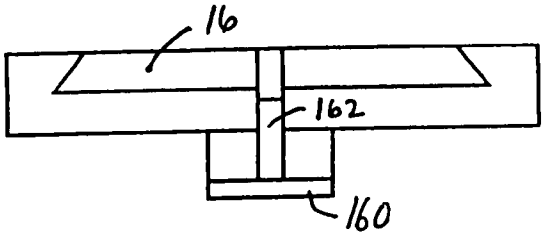
Figure 9:
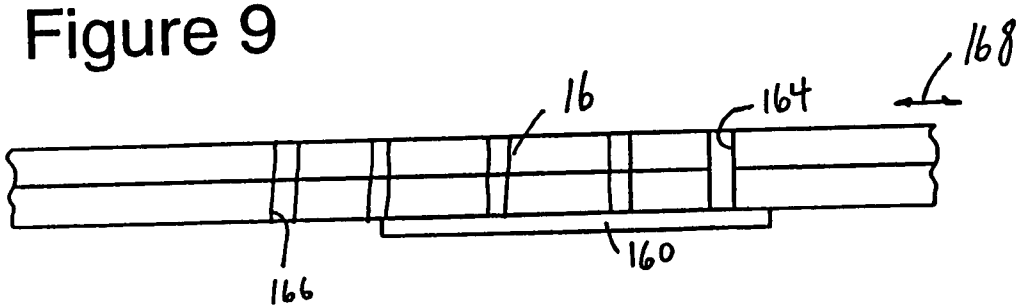
Figure 10:
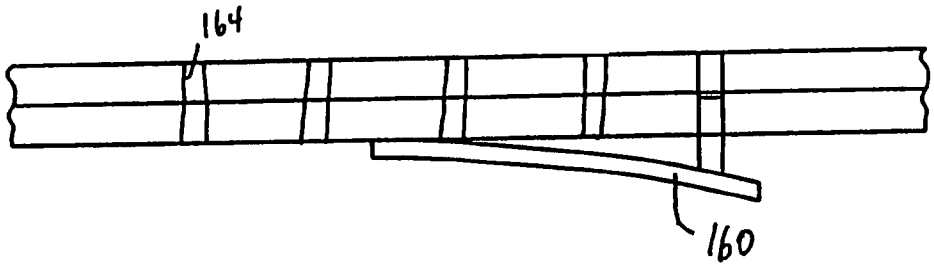

Likewise, in accordance with the present invention, it is contemplated that the knurled knobs illustrated in the embodiment of FIGS. 1-3 may be replaced by a lever 118 as illustrated in FIG. 4. Lever 118 includes a button 120 and is mounted on a pin 122, as may be seen most clearly in FIGS. 5 and 6. Pin 122, in turn, is supported in a clevis 124. After adjustment has been made, for example between vertical support member 34 and upper engagement foot 36, lever 118, which is in the position illustrated in dashed lines in FIG. 5, is advanced to the position shown in solid lines in FIG. 5 to result in securely maintaining those parts in a fixed relationship with respect to each other.

Locking is achieved due to the eccentric position of pin 122 which defines a radius 123 of greater magnitude than radius 125, thus causing lever 118 to rotate what is effectively a cam, tightening the parts against each other in much the same manner as levers of the type which lock wheels on bicycles.

Figure 7:
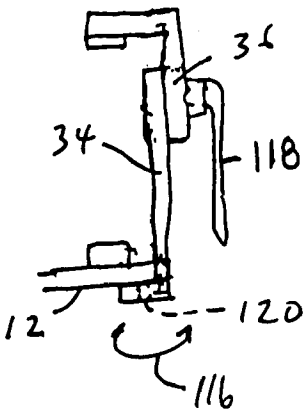
FIG. 7 shows the inventive tightening mechanism and a swiveling configuration to accommodate instrument curves.

In connection with this, reference is made to FIG. 7 where a lever 118, which is rotatably mounted on a base 12 using a pin 120 may be used to secure the two members in a desired position. Rotation in the directions of arrows 116 allows the bracket to match any desired shape.

In accordance with the invention, it is desirable that parts not vibrate. Such vibration has a number of undesirable effects. First, it may contribute to the sound of the instrument in an acoustic sense. This undesirable acoustic sound may be amplified, thus compounding the problem. The other possibility is that vibrations might be conducted by the bracket 110 to the microphone 112. This has the effect of compounding resonance problems and thus increasing noise.

Still yet another problem involves the sound deadening effect that a bracket has on the sound of the instrument. The combination of the large force needed to support a microphone and a secure anchorage in the body of the instrument combine to attenuate desirable resonance and deteriorate sound quality both acoustically and electrically.

In order to achieve these objectives, a number of structural features are adopted by the invention.

The force applied by the microphone bracket is minimized by having a bracket configuration which does not rely on friction to be held securely in place. The placement of the jaws defined between pads 18 and 20, and pad 66 at the lower end of the instrument, on the one hand and placement of the jaws defined between pads 30 and 32, and pad 40 at the upper end of the instrument is a balanced self-supporting structure that does not require friction and pressure in order to achieve a secure grip.

Moreover, the application pressure may be adjusted to act on the very periphery of the obverse and reverse faces of the instrument, thus applying that pressure to sidewalls 115 and 117. The optional rotational feature for the jaw is defined at the upper and lower sidewalls of the instrument allows optimization of this aspect of the invention.

The likelihood of vibration is yet further reduced by a pair of pads 150 and 152 which minimize the possibility of vibrations in any adjustable jaw mechanism.

As noted above, a microphone is selected for its having a relatively high mass. This desirable situation is reinforced by making the supporting structure comprising strap 110, base 94 and clevis 102 of a relatively rigid material, and minimizing the function of support strip 84 through the use of cooperating pads 96 and 98, insulating the microphone from vibration, while at the same time insulating the structure from higher speed components of microphone movement and momentum.

This last desirable aspect of the bracket may be improved by increasing the weight of base 94, clevis 102 and support strip. One option is to make one or more of these components of plastic which incorporates a heavyweight material, such as iron sand, as is used, for example, in exercising equipment. In accordance with this aspect of the invention, iron particles are incorporated with monomers in a mix which is polymerized as is appropriate for the particular monomer involved. The same may then be injection molded and formed into the desired shape.

One suitable mechanism for locking bracket 10 is illustrated in FIGS. 8-11. Track member 14 supports sliding rail 16. A leaf spring 160 maintains a pin 162 in position maintaining registration between a hole 164 in rail 16 and hole 166 in track member 14. When it is desired to move rail 16 in the direction of arrows 168, spring 160 is deflected to the position illustrated in FIGS. 10 and 11. This causes pin 162 to release rail 16, and allows rail 16 to move in the directions indicated by arrows 168. In accordance with the invention, it is contemplated that several different sized brackets will be provided for various ranges of instrument size.

Bracket 10 comprises an adjustable backer member 12. Adjustable backer 12 is formed by a track member 14 which defines a channel within which a rail 16 slides to adjust to the size of a guitar or other stringed instrument, such as a violin, viola or the like. Once adjusted, it may be locked in place by any suitable mechanism.

FIG. 12 illustrates an alternative embodiment of a bracket 210 constructed in accordance with the present invention. A plurality of suction cups 220 are secured to a base 224. Suction cups 220 engage a guitar 244 on the side wall of the guitar, which is typically near the bottom of the guitar when it is being played. Base 224, in turn, supports a microphone boom 294. Boom 294 may be made of any desired shape that allows placement of the microphone as desired. For example, it may take the form of the letter U. Boom 294 terminates in a clamp 310. Clamp 310 engages a microphone 312, whose position may be adjusted. The structure of boom 294 may take a number of forms which may allow, for example, pivotal movement at the juncture between base 224 and boom 294. Likewise, pivotal movement of microphone 312 may be provided adjacent clamp 310.

In use, bracket 210 is engaged on a guitar 244 by pressing suction cups 220 against the guitar body, as illustrated. The position of the microphone 312 may then be adjusted at a desired position.

Still yet another alternative of the inventive bracket 510 is illustrated in FIG. 13. This embodiment is similar to the embodiment of FIG. 12, except that a single suction cup 520 is employed.

FIG. 14 illustrates yet another alternative embodiment of a bracket 720 constructed in accordance with the present invention. In this case, bracket 720 is adhered to the large planar surface of the guitar 844 adjacent the strings.

FIG. 15 is a detail illustrating a suction cup 410 used in the embodiment, for example, of FIG. 14. Suction cup 410 includes a nib 411 which may be moved in the direction 413 illustrated in FIG. 16 to disengage the suction cup from the surface of a guitar 644. In use, suction cup 410 is pressed against the surface of the guitar, resulting in flattening of suction cup 410 and in engaging of the guitar, as illustrated in FIG. 16. It may then be disengaged by flexure of nib 411.

If desired, a lever 415 may be employed in the suction cup to provide for easier engagement and disengagement of suction cup 410, as is illustrated in dashed lines in FIG. 15. Similar suction cup mounting structures, which may also be used in accordance with the present invention, are used to mount pencil sharpeners to a flat surface. After being pressed into engagement with the surface of a guitar 644, as illustrated in FIG. 17, lever 415 may be urged in the direction of arrow 417 to place the device into the configuration illustrated in FIG. 18. When it is desired to disengage the suction cup, lever 415 may be moved to the position shown in dashed lines in FIG. 18, allowing for easy removal of the inventive bracket.

Referring to FIG. 19, a particularly advantageous version of the inventive microphone bracket 500 is illustrated. Bracket 500 comprises an adjustable backer member 512. Backer member 512 comprises a rail 514 to which a lever incorporating bolt 516 is secured (FIG. 20). In accordance with the preferred embodiment, bolt 516 is welded perpendicular to the hidden side of backer member 512 in FIG. 19 and supports a wingnut, a threaded lever 518 or other alternative tightening member.

A pad 521 (FIG. 19), made of a resilient rubber material, felt or the like prevents vibrational sound from being introduced into the microphone, and also protects the side of the guitar or other stringed instrument to which the bracket is secured. A flexible plastic suction cup 522 is secured in an appropriate hole or slot 524 in backer member 512.

Rail 514 includes a pair of side flanges 526, which serve to guide and retain a slider 528 for movement on rail 514 in the directions indicated by arrow 530. Backer member 512 defines a jaw supporting suction cup 522. An opposing jaw is formed by plate 532 acting together with suction cups 534 and 536 which are mounted in slots 538 and 540 defined in plate 532. In accordance with the preferred embodiment, plate 532 is integrally formed with slider 528, by stamping a single piece of metal and bending it to form plate 532 and slider 528.

Bolt 516 extends through a slot 542 in slider 528. In accordance with the preferred embodiment of the invention, the space between the suction cup 522 on one side, and suction cups 534 and 536 on the other side forms a jaw with an opening for gripping a guitar 544 or other musical instrument. The magnitude of the opening may be varied by sliding slider 528 to a desired position along rail 514. The magnitude of the opening may be fixed, after adjustment, by locking slider 528 in position by rotating nut 518 to tighten and secure rail 514 to slider 528.

A microphone support rod 546 is secured by a support sleeve 548 and welding, or a bolt or similar artifice to plate 532. Microphone support rod 546, in turn, is held in a U-shaped clamp 550, as can be seen most easily with reference to FIGS. 21 and 22. Clamp 550 is provided with a rod engaging internal race 552. Clamp 550 is tightened and secured in place by rotation of a knob 554 which is threadedly mounted on a bolt 556. Bolt 556 is secured to a specialized head 558 which is a solid member and which defines a hole 560.

Bolt 556 sits in a cup 562. Cup 562 defines a radial hole 564 and an axial hole 566. Bolt 556 passes through axial hole 566 and through a spring 568. Bolt 556 is positioned with hole 560 in its head 558 aligned with the hole 564 in cup 562. A rod 570 passes through holes 560 and 564.

Tensioned by spring 568, rotation of knob 564 results in pulling head 558 and rod 570 in the direction indicated by arrow 572 and at the same time, urging cup 562 in the direction indicated by arrow 574, while at the same time tightening clamp 550 around rod 546.

A microphone 576 is held in place by a frictional clamp 578, which frictionally engages microphone 576. Clamp 578 may be made of metal, plastic or any suitable material, and is secured to rod 570. Thus, one may secure microphone 576 in any one of numerous positions. This is done by first adjusting slider 528 relative to rail 514, in order to get a tight grip on guitar 544, and then tightening threaded lever 518. Once the inventive microphone mount 500 has thus been secured in position, microphone 576 may be moved closer or further from guitar 544 in the directions indicated by arrows 580, axially with respect to rod 546 in the directions indicated by arrows 582 by rotation on clamp 550, and angularly in the directions indicated by arrows 582 by rotation of rod 570 in cup 562. Tightening of knob 554 then secures the microphone in the desired position.

When it is desired to relocate microphone support 500, or remove it from guitar 544 entirely, threaded lever 518 is loosened, and suction cups 522, 534 and 536 released by outward flexure of suction cup nibs 584. Finally, while a wireless microphone may be used, it is also possible to use a microphone with a microphone cable. This cable may be clipped by alligator clamp 586 which is rotatably secured to plate 532.

While illustrative embodiments of the invention have been described, it is, of course, understood that various modifications will be obvious to those of ordinary skill in the art. Such modifications are within the spirit and scope of the invention which is limited and defined only by the appended claims.

The invention claimed is:

1. A microphone bracket for supporting a microphone on a stringed musical instrument, comprising:

(a) a base member having first and second ends;

(b) an upper mounting member secured to one end of said base member, said upper mounting member, comprising:

(i) a first padded jaw positioned to engage the obverse of said stringed instrument;

(ii) a second padded jaw positioned to engage the reverse of said stringed instrument; and (iii) said first and second padded jaws being connected by a first connecting member of adjustable length, said first connecting member being configured to secure said first and second padded jaws in engagement with the obverse and reverse of said stringed instrument;

(c) a lower mounting member secured to the other end of said base member, said lower mounting member, comprising:

(i) a third padded jaw positioned to engage the obverse of said stringed instrument;

(ii) a fourth padded jaw positioned to engage the reverse of said stringed instrument; and (iii) said third and fourth padded jaws being connected by a second connecting member of adjustable length, said second connecting member being configured to secure said third and fourth padded jaws in engagement with the obverse and reverse of said stringed instrument; and (d) a microphone holder secured to one of said mounting members, said microphone holder being configured to support said microphone at a position spaced apart from the plane defined by the obverse of said stringed musical instrument.

2. A bracket as in claim 1 wherein said jaw members may be locked into position.

3. A bracket as in claim 2 wherein said jaw members are fitted with deformable pads.

4. A bracket as in claim 3, wherein said pads are made of a rubber-like material.

5. A bracket as in claim 1, wherein said base member is of adjustable length.

6. A bracket as in claim 1, wherein said microphone holder is supported by a pair of vibration absorbing members.

7. A bracket for a musical instrument as in claim 1, wherein said padded jaw members comprise suction cups positioned be substantially parallel with the obverse or reverse of the instrument.

8. A bracket for mounting a microphone on a stringed musical instrument, comprising:

(a) a connection member comprising:

(i) an obverse member comprising an obverse jaw end; and (ii) a reverse member comprising a reverse jaw end;

(b) an obverse mounting member secured to said obverse jaw end of said connection member;

(c) a reverse mounting member secured to said reverse jaw end of said connection member;

(d) an obverse suction cup secured to said obverse mounting member;

(e) a reverse suction cup secured to said reverse mounting member; and (f) a microphone holder secured with respect to one of said mounting members, wherein the connection member, in cooperation with the obverse and reverse suction cups, secures the bracket to the body of a stringed musical instrument.

9. A microphone bracket as in claim 1, wherein said upper and lower mounting members are positioned to engage the sidewall edge of said stringed musical instrument.

10. A bracket as in claim 4, wherein pads are made of felt.

11. A bracket as in claim 8, further comprising:

(a) a connection member comprising:

(i) an obverse member comprising an obverse jaw end; and (ii) a reverse member comprising a reverse jaw end;

(b) an obverse mounting member secured to obverse jaw end of said connection member;

(c) a reverse mounting member secured to reverse jaw end of said connection member;

(d) an obverse suction cup secured to said obverse mounting member;

(e) a reverse suction cup secured to said reverse mounting member;

(f) a microphone holder secured to said mounting member; and (g) a microphone secured to said microphone holder.

12. A bracket as in claim 8, wherein said microphone holder comprises an elongated member supporting said microphone at a point displaced from the plane defined by said obverse side of said stringed musical instrument.

13. A bracket as in claim 8, further comprising an additional obverse suction cup secured to said obverse mounting member.

14. A bracket as in claim 8, wherein said microphone holder comprises first and second holder elements that mate with each other at a plurality of positions and a holder securement for locking aid first and second holder elements at a selectable relative position.

* * * * *